US009072156B2

(12) United States Patent
Caporaso et al.

(10) Patent No.: US 9,072,156 B2
(45) Date of Patent: Jun. 30, 2015

(54) DIAMAGNETIC COMPOSITE MATERIAL STRUCTURE FOR REDUCING UNDESIRED ELECTROMAGNETIC INTERFERENCE AND EDDY CURRENTS IN DIELECTRIC WALL ACCELERATORS AND OTHER DEVICES

(71) Applicant: Lawrence Livermore National Security, LLC, Livermore, CA (US)

(72) Inventors: George J. Caporaso, Livermore, CA (US); Brian R. Poole, Livermore, CA (US); Steven A. Hawkins, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 257 days.

(21) Appl. No.: 13/842,597

(22) Filed: Mar. 15, 2013

(65) Prior Publication Data

US 2014/0265940 A1 Sep. 18, 2014

(51) Int. Cl.
*H05H 7/00* (2006.01)
*H05H 9/00* (2006.01)

(52) U.S. Cl.
CPC ..... *H05H 9/005* (2013.01)

(58) Field of Classification Search
CPC ..... H05H 9/005; H05H 9/002
See application file for complete search history.

(56) References Cited

U.S. PATENT DOCUMENTS 6,483,481 B1 11/2002 Sievenpiper et al.
7,136,028 B2 11/2006 Ramprasad et al.
7,136,029 B2 11/2006 Ramprasad et al.
7,170,363 B2 1/2007 Wiltshire et al.
7,173,385 B2 * 2/2007 Caporaso et al. ..... 315/505
7,576,499 B2 * 8/2009 Caporaso et al. ..... 315/505
7,615,942 B2 * 11/2009 Sanders et al. ..... 315/505
8,466,429 B2 * 6/2013 Guethlein ..... 250/396 R
8,575,868 B2 * 11/2013 Caporaso et al. ..... 315/505
8,598,813 B2 * 12/2013 Joshkin et al. ..... 315/505
8,749,949 B2 * 6/2014 Caporaso et al. ..... 361/312

(Continued)

OTHER PUBLICATIONS

Yu Jiuan Chen "High Gradient Dielectric Wall Accelerators" Aug. 12, 2008 Presentation at Muoan Collider Design Workshop 2008.*

(Continued)

*Primary Examiner* — Douglas W Owens
*Assistant Examiner* — Srinivas Sathiraju
(74) *Attorney, Agent, or Firm* — Perkins Coie LLP

(57) ABSTRACT

The devices, systems and techniques disclosed here can be used to reduce undesired effects by magnetic field induced eddy currents based on a diamagnetic composite material structure including diamagnetic composite sheets that are separated from one another to provide a high impedance composite material structure. In some implementations, each diamagnetic composite sheet includes patterned conductor layers are separated by a dielectric material and each patterned conductor layer includes voids and conductor areas. The voids in the patterned conductor layers of each diamagnetic composite sheet are arranged to be displaced in position from one patterned conductor layer to an adjacent patterned conductor layer while conductor areas of the patterned conductor layers collectively form a contiguous conductor structure in each diamagnetic composite sheet to prevent penetration by a magnetic field.

23 Claims, 12 Drawing Sheets

(56) References Cited

U.S. PATENT DOCUMENTS

| | | | | |
|---|---|---|---|---|
| 2007/0138980 | A1* | 6/2007 | Sanders et al. | 315/505 |
| 2007/0145916 | A1* | 6/2007 | Caporaso et al. | 315/505 |
| 2009/0224700 | A1* | 9/2009 | Chen et al. | 315/505 |
| 2012/0086364 | A1* | 4/2012 | Guethlein | 315/505 |
| 2012/0126727 | A1* | 5/2012 | Hamm | 315/505 |
| 2012/0181456 | A1* | 7/2012 | Chen | 250/492.3 |
| 2013/0106316 | A1* | 5/2013 | Caporaso et al. | 315/506 |
| 2014/0035588 | A1* | 2/2014 | Botto | 324/333 |

OTHER PUBLICATIONS

Sievenpiper, "High Impedance Electromagnetic Surfaces with a Forbidden Frequency Band", IEEE Transactions on Microwave Theory and Techniques, vol. 47, No. 11, pp. 2059-2074 (Nov. 1999).

Wltshire, et al., "Microstructured Magnetic Materials for RF Flux Guides Magnetic Resonance Imaging", Science, vol. 291, pp. 849-851 (Feb. 2, 2001).

* cited by examiner

FIG. 2A
Outer Layer 1
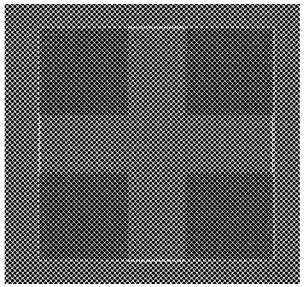
FIG. 2B
Middle Layer
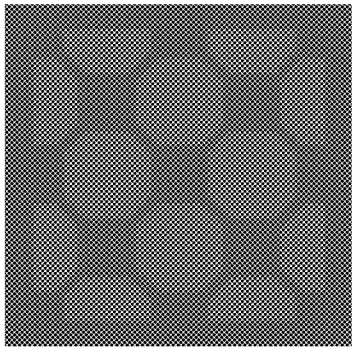
FIG. 2C
Outer Layer 2
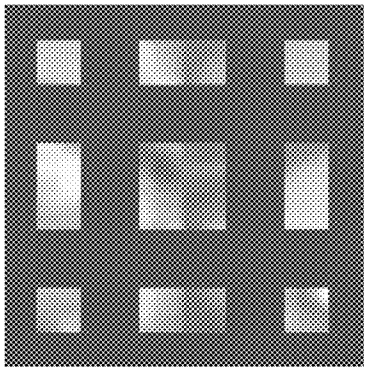
Composite Structure
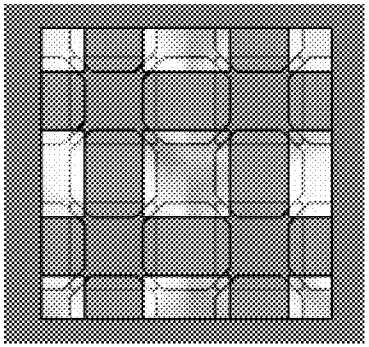
FIG. 2D

DIAMAGNETIC COMPOSITE MATERIAL STRUCTURE FOR REDUCING UNDESIRED ELECTROMAGNETIC INTERFERENCE AND EDDY CURRENTS IN DIELECTRIC WALL ACCELERATORS AND OTHER DEVICES

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

TECHNICAL FIELD

This patent document relates to systems and devices that carry time-varying electric currents, including pulse voltage circuits used in charged particle accelerators and other devices.

BACKGROUND

Various electric circuits and systems can generate time-varying or transient magnetic fields, e.g., in circuits or electrical devices that carry time-varying currents. Such time-varying magnetic fields in turn can induce, via electromagnetic induction, eddy currents in conductors and electromagnetic interference in circuit elements or devices that are exposed to such time-varying magnetic fields. The magnetic field induced eddy currents may have undesired effects, e.g., loss of electromagnetic energy, heating caused by presence of eddy currents, electromagnetic interference by the presence of eddy currents and others.

SUMMARY

The devices, systems and techniques disclosed here can be used to reduce undesired effects by magnetic field induced eddy currents based on a diamagnetic composite material structure including diamagnetic composite sheets that are separated from one another to provide a high impedance composite material structure. In some implementations, each diamagnetic composite sheet includes patterned conductor layers are separated by a dielectric material and each patterned conductor layer includes voids and conductor areas. The voids in the patterned conductor layers of each diamagnetic composite sheet are arranged to be displaced in position from one patterned conductor layer to an adjacent patterned conductor layer while conductor areas of the patterned conductor layers collectively form a contiguous conductor structure in each diamagnetic composite sheet to prevent penetration by a magnetic field.

In one example, a device having a reduced electromagnetic interference is provided to include a series of circuits located adjacent to one another, each circuit including electrical conductors to carrying one or more time-varying electric currents which induce one or more time-varying magnetic fields that extend to one or more adjacent circuits and thus induce magnetic field induced eddy currents in electrical conductors of the one or more adjacent circuits. This device includes a diamagnetic composite material structure coupled to the circuits to surround the circuits to provide a high impedance composite material structure and the diamagnetic composite sheets are electrically coupled to the circuits, respectively, to reduce a magnetic field induced eddy current in one circuit that is caused by another circuit. The patterned conductor layers in each diamagnetic composite sheet are electrically coupled to electrical conductors of a respective circuit.

In another example, a dielectric wall accelerator for accelerating charged particles can be implemented based on such a diamagnetic composite material structure. The dielectric wall accelerator includes a dielectric tube to receive a pulse of charged particles propagating along a tube lengthwise direction of the dielectric tube and a series of unit cells located outside, and engaged to, different tube sections of the dielectric tube. The unit cells each include parallel electrical conductor lines transversely connected to the different tube sections, respectively, and spaced apart along the tube lengthwise direction to apply electrical signals to effectuate acceleration electrical fields at the different tube sections along the tube lengthwise direction inside the dielectric tube. A control device is coupled to the unit cells to supply electrical power to the parallel electrical conductor lines within the unit cells and to control the unit cells to turn on and off the applied electrical signals in the unit cells, respectively, one unit cell at a time sequentially along the tube lengthwise direction to synchronize the acceleration electrical field at the different tube sections with propagation of the pulse of charged particles to accelerate the charged particles. The diamagnetic composite material structure is outside the unit cells to surround the dielectric tube and the unit cells. Each diamagnetic composite sheet is connected to at least one conductor line in a respective unit cell to reduce a magnetic field induced current.

In yet another example, a method is provided for reducing electromagnetic interference in a dielectric wall accelerator for accelerating charged particles. The dielectric wall accelerator includes a dielectric tube, a stack of Blumlein unit cells located outside, and engaged to, different tube sections of the dielectric tube to apply electrical signals to effectuate acceleration electrical fields at the different tube sections along a tube lengthwise direction inside the dielectric tube. This method includes providing a diamagnetic composite material structure outside the Blumlein unit cells to surround the dielectric tube and the Blumlein unit cells to reduce magnetic interference caused by one Blumlein unit cell to other Blumlein unit cells, and connecting each diamagnetic composite sheet to one or more conductors in a respective Blumlein unit cell to reduce a magnetic field induced current.

These and other aspects and features are described in greater detail in the drawings, the description and the claims.

BRIEF DESCRIPTION OF THE DRAWINGS

FIGS. 2A, 2B, 2C and 2D show one example of a 3-layer diamagnetic composite sheet that has 3 different patterned conductor layers.

DETAILED DESCRIPTION

Diamagnetic composite material structures disclosed herein can be used to reduce undesired effects of magnetic field induced eddy currents by blocking magnetic fields or providing high impedance at conductors or circuits where the eddy currents are to be generated. The high impedance aspect of the disclosed diamagnetic composite material structures can be achieved by using diamagnetic composite sheets that are separated from one another and are electrically coupled different conductors or circuits in a device or system.

In one aspect, each diamagnetic composite sheet can include, in some implementations, patterned conductor layers are separated by a dielectric material and each patterned conductor layer includes non-conductive regions or voids and conductor areas that are spatially arranged relative to one another to provide discontinuous conductor paths for any electrical current in the layer and thus produces a high electric impedance configuration in such a layer. For example, a patterned conductor layer in each diamagnetic composite sheet may be a conductor sheet in which the conductor areas are connected to define holes as the voids, or spatially distributes conductor areas that are separated from one another by the voids, or uses separated conductor areas that are closed conductor loops with voids within the loops, or uses separated conductor areas that are contiguous conductor patches but are separated by non-conductive regions or voids.

Figures 1A, 1B, 1C, 1D:
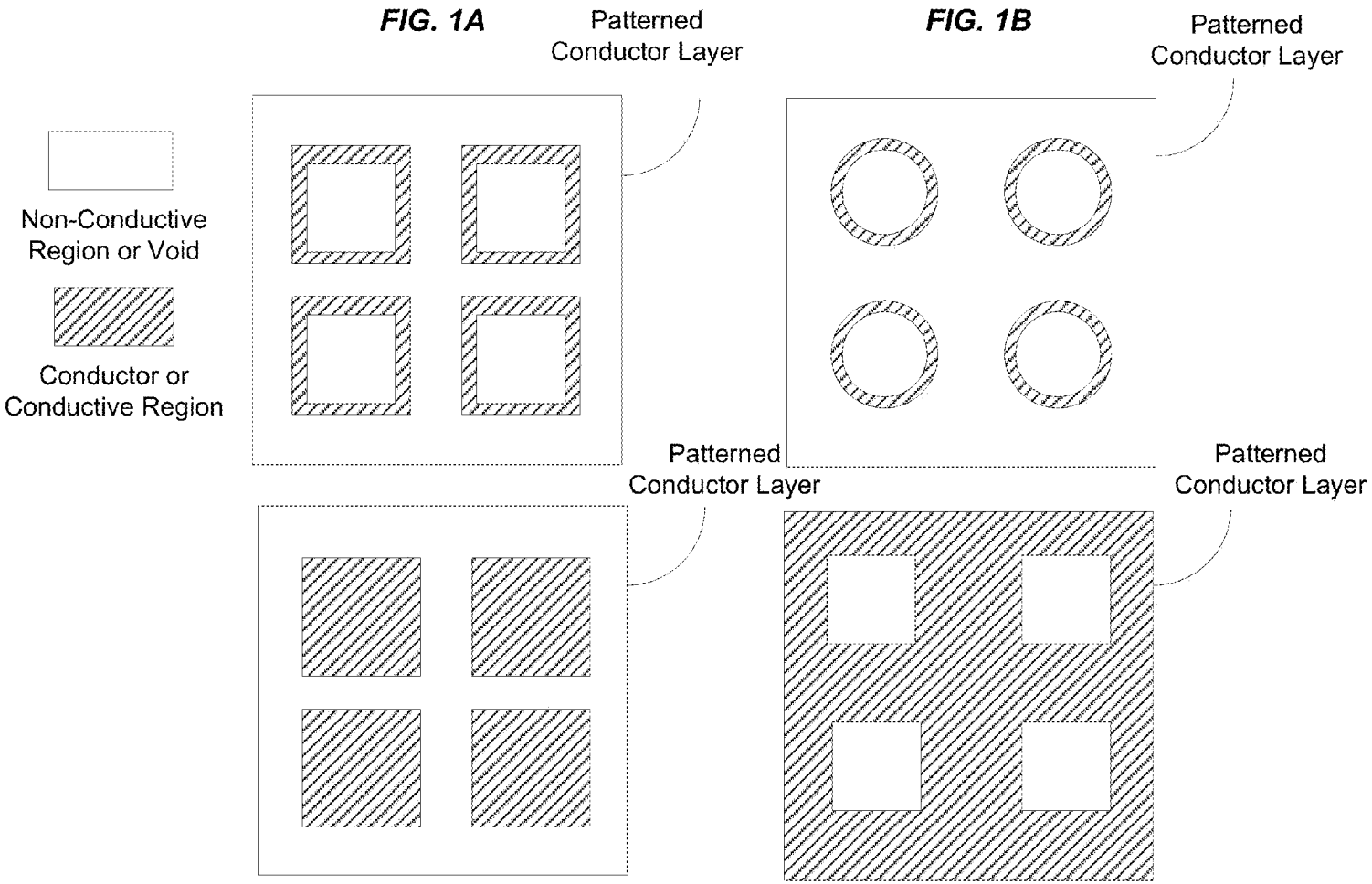
FIGS. 1A, 1B, 1C and 1D show examples of patterned conductor layers that can be used to construct such a diamagnetic composite sheet.

FIGS. 1A, 1B, 1C and 1D show examples of patterned conductor layers that can be used to construct such a diamagnetic composite sheet. FIG. 1A shows an example of a patterned conductor layer that has separated square conductor rings with hollow centers to form a high impedance layer. FIG. 1B shows an example of a patterned conductor layer that has separated circular conductor rings with hollow centers to form a high impedance layer. FIG. 1C shows an example of a patterned conductor layer that has separated contiguous square conductor patches to form a high impedance layer. FIG. 1D shows an example of a patterned conductor layer that has separated square holes in a conductor layer to form a high impedance layer. These and other designs of patterned conductor layers having non-conductive regions or voids and conductor areas can be stacked together to form diamagnetic composite sheets.

In another aspect, the non-conductive regions or voids in the patterned conductor layers of each diamagnetic composite sheet are arranged to be displaced in position from one patterned conductor layer to an adjacent patterned conductor layer to enable conductor areas of the different patterned conductor layers to collectively form an effective contiguous conductor structure in each diamagnetic composite sheet. This effective contiguous conductor structure in each diamagnetic composite sheet provides the blocking of the undesired transient or time-varying magnetic field.

FIGS. 2A, 2B, 2C and 2D show one example of a 3-layer diamagnetic composite sheet that has 3 different patterned conductor layers. FIGS. 2A, 2B and 2C show the three patterned conductor layers with different patterns of conductor areas and non-conductive regions or voids, respectively. The patterns in the three patterned conductor layers in FIGS. 2A, 2B and 2C are selected so that they can be stacked to form the 3-layer diamagnetic composite sheet in FIG. 2D where every location over the 3-layer diamagnetic composite sheet is covered by a conductor area by at least one of the stacked patterned conductor layers shown in FIGS. 2A, 2B and 2C and thus to form a contiguous conductor structure.

Figure 2E:
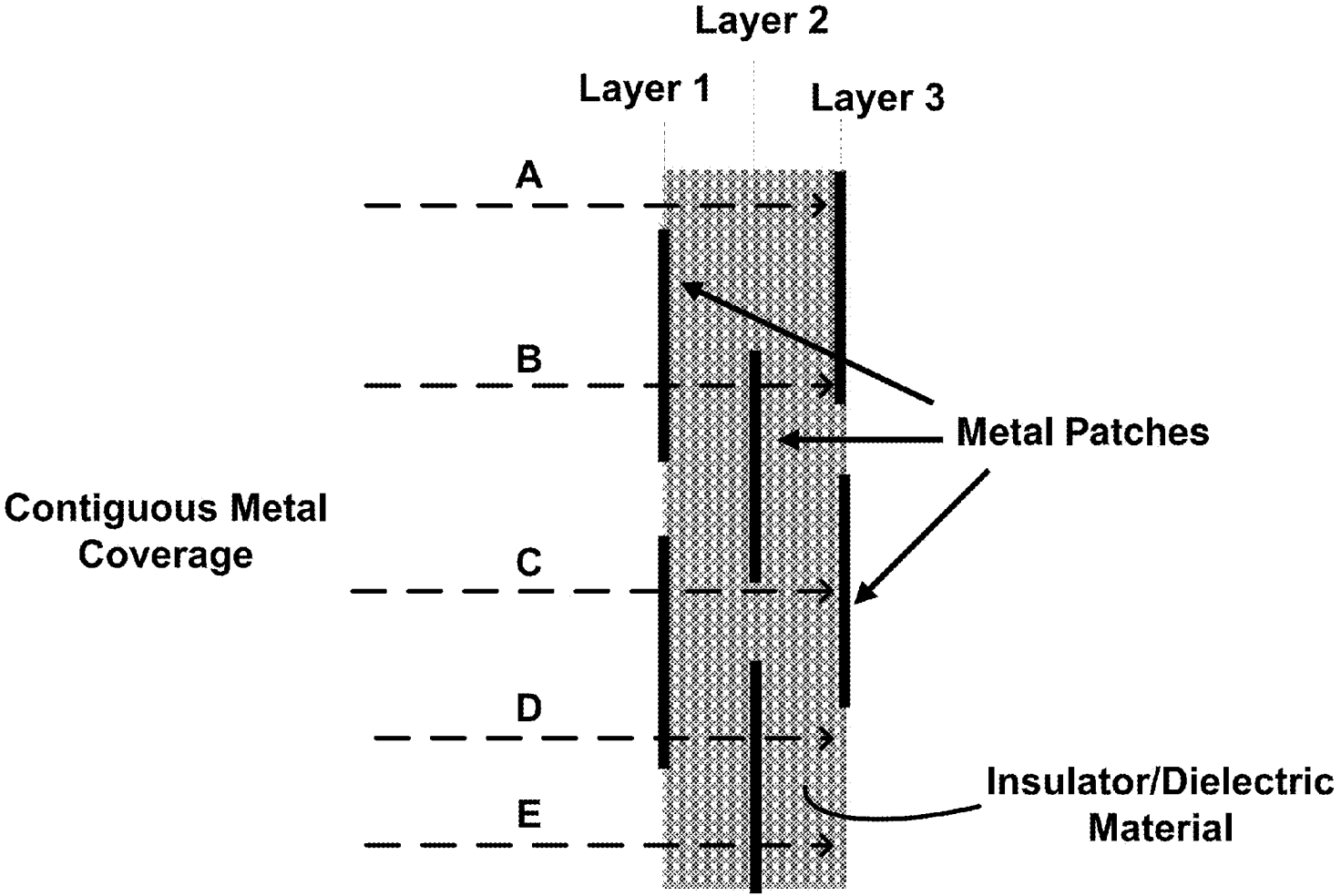
FIG. 2E further shows a side view of the above contiguous conductor structure of the 3-layer diamagnetic composite sheet in FIG. 2D.

FIG. 2E further shows a side view of the above contiguous conductor structure of the 3-layer diamagnetic composite sheet in FIG. 2D. The arrowed lines represent a side view at different locations of the 3-layer diamagnetic composite sheet in FIG. 2D and every location is covered by a conductor area in at least one of the three patterned conductor layers. For example, at location A, the conductor coverage is provided by a conductor area in the layer 3; at location B, the conductor coverage is provided by 3 conductor areas in the layers 1, 2 and 3; at location C, the conductor coverage is provided by 2 conductor areas in the layers 1 and 3; at location D, the conductor coverage is provided by 2 conductor areas in the layers 1 and 2; and at location E, the conductor coverage is provided by one conductor area in the layer 2.

Figure 3:
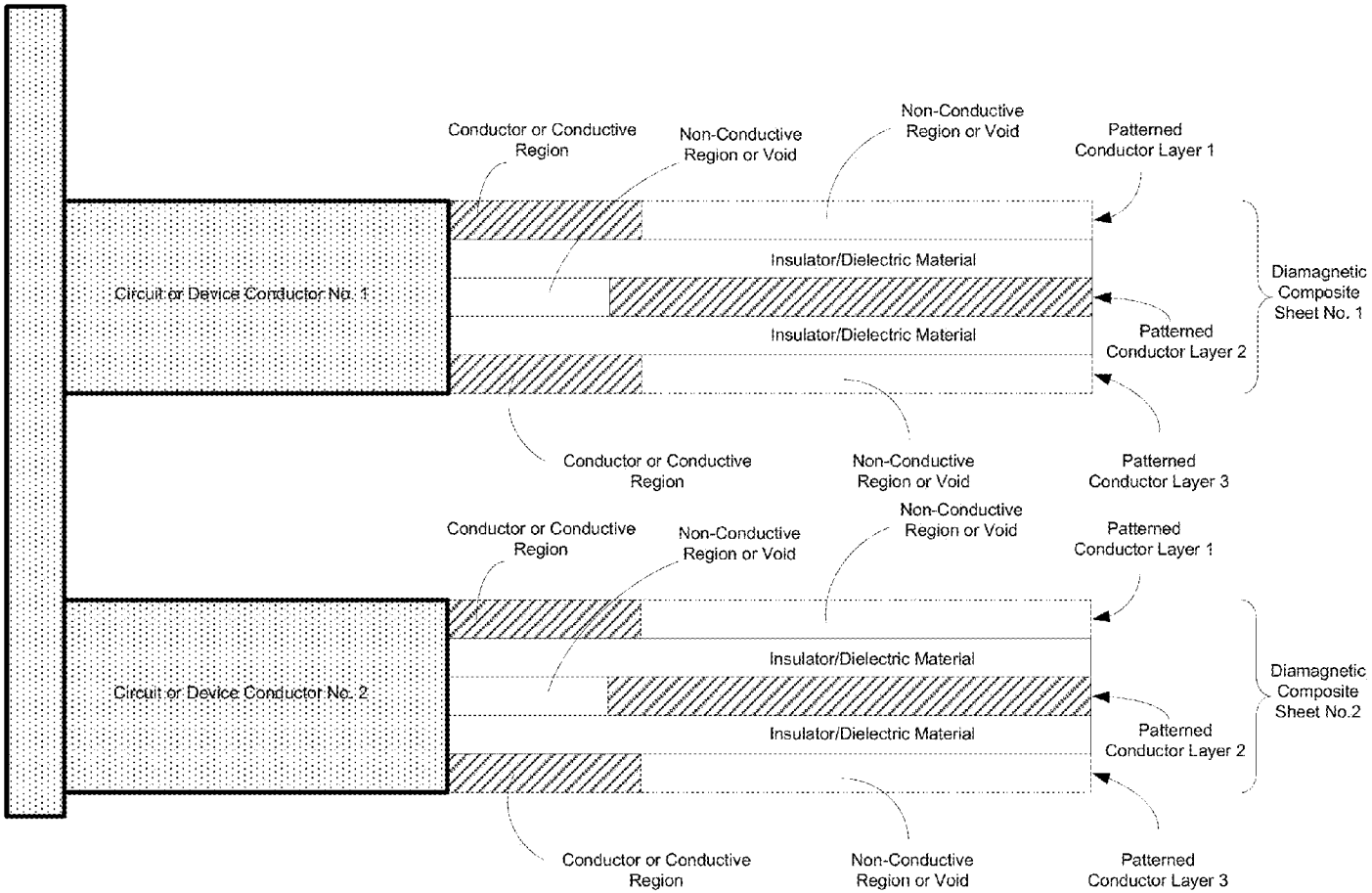
FIG. 3 illustrates a circuit or device having conductors No. 1 and No. 2 that carry time-varying currents in operation (e.g., an electrical current pulse) so that such a time-varying current generates a transient magnetic field at one or more adjacent conductors.

FIG. 3 illustrates a circuit or device having conductors No. 1 and No. 2 that carry time-varying currents in operation (e.g., an electrical current pulse) so that such a time-varying current generates a transient magnetic field at one or more adjacent conductors. The transient magnetic field induces an eddy current. Two diamagnetic composite sheets No. 1 and No. 2 each having three patterned conductor layers are respectively coupled to the conductors No. 1 and No. 2 to provide an all metal exterior structure to block a transient magnetic field and to also provide a high electric impendence surface in each of the patterned conductor layers to reduce any induced eddy current. In this example, at least two patterned conductor layers of a diamagnetic composite sheet are electrically coupled to a circuit conductor No. 1 or 2. In other implementations, one patterned conductor layer may be electrically coupled to a circuit conductor No. 1 or 2.

Figure 4:
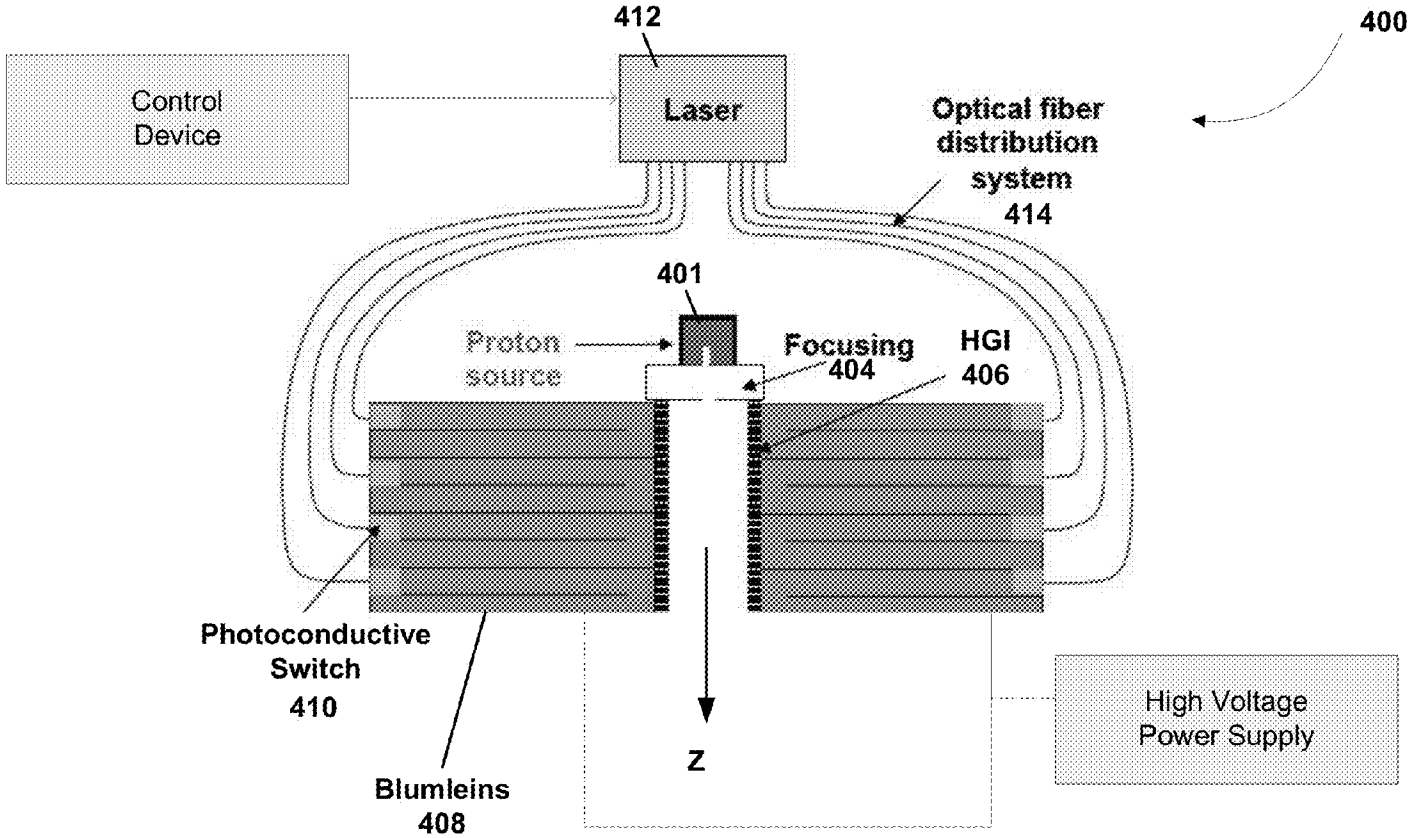
FIG. 4 shows a specific example of an application of the diamagnetic composite sheets as shown in FIG. 3.

FIG. 4 shows a specific example of an application of the diamagnetic composite sheets as shown in FIG. 3. In FIG. 4, a dielectric wall accelerator (DWA) system 400 based on a series of Blumleins unit cells 408 coupled to a dielectric tube 406 to receive a pulse of charged particles (e.g., protons) propagating along a tube lengthwise direction z of the dielectric tube 406. A particle source 401 (e.g., a proton source) is provided to produce the charged particles. A particle focusing device 404 is used to focus the charged particles into the dielectric tube 406 that provides an accelerating electric field along the longitudinal or tube lengthwise direction (z) for accelerating the charged particles. The focusing device 404 can include to a radio frequency quadrupole (RFQ) that provides focusing, bunching and acceleration for the charged particles.

Such particle accelerators are used to increase the energy of electrically-charged particles, e.g., electrons, protons, or charged atomic nuclei. High energy electrically-charged particles can be used in various application. For example, high energy electrically-charged particles can be accelerated to collide with a target such as atoms or molecules to break up the nuclei of the target atoms or molecules and interact with other particles. The resulting products are observed with a detector. At very high energies the accelerated charged particles can cause transformations in a target caused by the collision which can be used to discern the nature and behavior of fundamental units of matter. Particle accelerators are also important tools in the effort to develop nuclear fusion devices, and in medical applications such as proton therapy for cancer treatment, which is also known as hadron therapy.

The Blumleins unit cells 408 are located outside, and engaged to, different tube sections of the dielectric tube 406. The unit cells each include parallel electrical conductor lines transversely connected to the different tube sections, respectively, and spaced apart along the tube lengthwise direction to apply electrical signals to effectuate acceleration electrical fields at the different tube sections along the tube lengthwise direction inside the dielectric tube 406. A control device is coupled to the Blumleins unit cells 408 to supply electrical power to the parallel electrical conductor lines within the Blumleins unit cells 408 and to control the Blumleins unit cells 408 to turn on and off the applied electrical signals in the Blumleins unit cells 408, respectively, one unit cell at a time sequentially along the tube lengthwise direction to synchronize the acceleration electrical field at the different tube sections with propagation of the pulse of charged particles to accelerate the charged particles. The dielectric tube 406 can be implemented in various configurations, including a contiguous dielectric material tube that is entirely made of a dielectric material or a tube formed by alternating conductor layers and dielectric layers as a high gradient insulator tube.

The control device in FIG. 4 uses a laser 412 and photoconductive switches 410 located in the series of Blumleins unit cells 408 to control the timing of high voltage pulses in the Blumleins unit cells 408 to energize different section of the dielectric tube 406 through timed activation of photoconductive switches 410 to turn on and off Blumleins unit cells 408 along the tube lengthwise direction in synchronization with the propagation of the charged particles in the tube 406 so that the charged particles continue experiencing an accelerating electric field in each tube section. In this example, optical fibers 414 are used to deliver laser pulses from the laser 412 to the photoconductive switches 410. In other implementations, the control device may use other switching mechanisms to provide the synchronized on and off operations of the Blumleins unit cells 408.

Figure 5A:
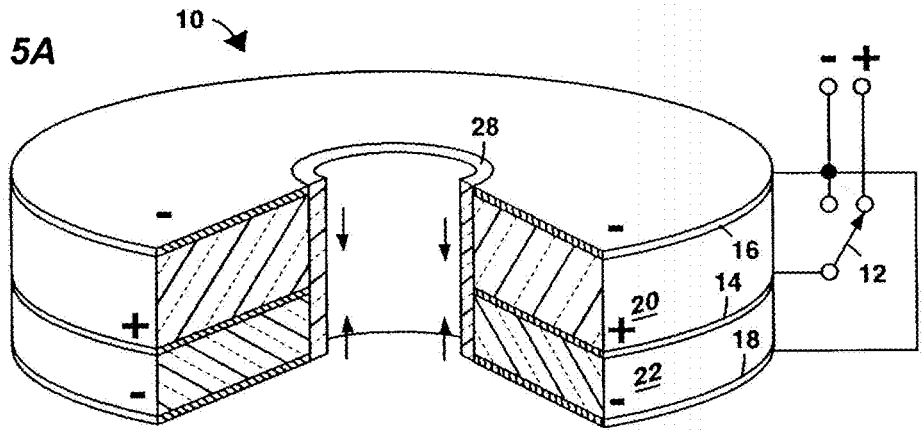
FIG. 5A, FIG. 5B and FIG. 5C provide exemplary diagrams that illustrate the operation of a single Blumlein unit cell for a DWA tube section as the building block for the DWA of FIG. 4.
Figure 5B:
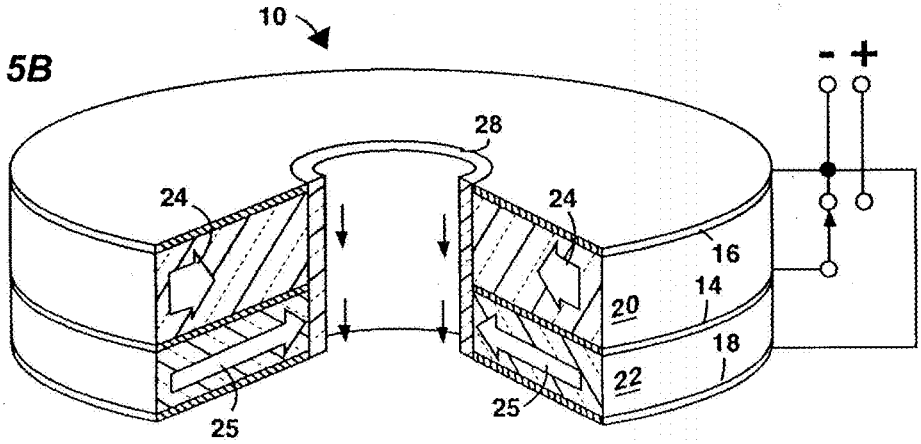
Figure 5C:
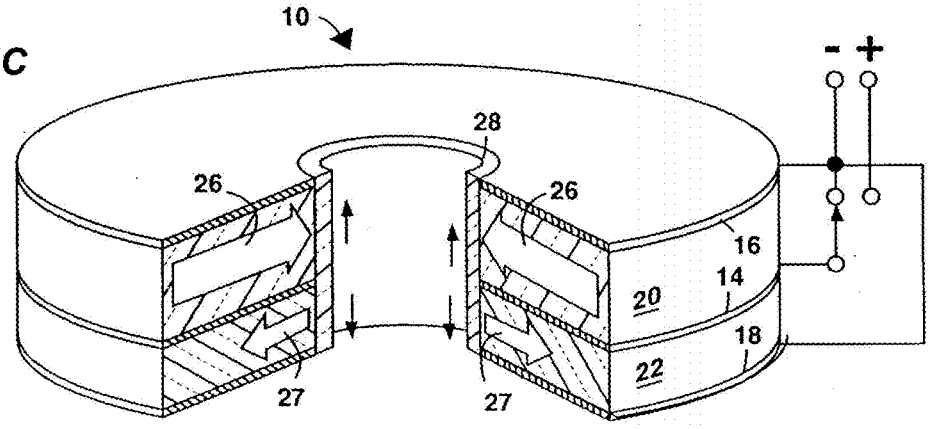

FIG. 5A, FIG. 5B and FIG. 5C provide exemplary diagrams that illustrate the operation of a single Blumlein unit cell 10 for a DWA tube section under the control of a switch 12, powered by a radial transmission line, that can be utilized as the building block for the DWA of FIG. 4. FIGS. 5A-5C provide a time-series that is related to the state of the switch 12. A tube section 28 fabricated from a dielectric material is molded or otherwise formed on the inner diameter of the single accelerator cell 10 to provide a dielectric wall. The cut up discs in FIGS. 2A to 2C are conductors as radial transmission lines. Each radial transmission line consists of a slow-medium disc and a fast-medium disc for propagation of signals, as will be described in detail below. A particle beam is introduced at one end of the dielectric wall 28 that accelerates along the central axis. The switch 12 is connected to allow the middle conductive plate 14 to be charged by a high voltage source. An insulator material 20, e.g., a laminated dielectric material, with a relatively high dielectric constant separates the conductive plates 14 and 16. Another insulator material 22, e.g., another laminated dielectric material, with a relatively low dielectric constant separates the conductive plates 14 and 18. In the exemplary diagram of FIGS. 5A-5C, the middle conductive plate 14 is set closer to the bottom conductive plate 18 than to the top conductive plate 16, such that the combination of the different spacing and the different dielectric constants results in the same characteristic impedance on both sides of the middle conductive plate 14. Although the characteristic impedance may be the same on both halves, the propagation velocity of signals through each half is not the same. The higher dielectric constant half with laminated dielectric 20 is much slower. This difference in relative propagation velocities is represented by a short fat arrow 24 and a long thin arrow 25 in FIG. 5B, and by a long fat arrow 26 and a reflected short thin arrow 27 in FIG. 5C.

In a first position of the switch 12, as shown in FIG. 5A, both halves are oppositely charged so that there is no net voltage along the inner length of the assembly. After the lines have been fully charged, the switch 12 closes across the outside of both lines at the outer diameter of the single accelerator cell, as shown in FIG. 5B. This causes an inward propagation of the voltage waves 24 and 25 which carry opposite polarity to the original charge such that a zero net voltage will be left behind in the wake of each wave. When the fast wave 25 hits the inner diameter of its line, it reflects back from the open circuit it encounters. Such reflection doubles the voltage amplitude of the wave 25 and causes the polarity of the fast line to reverse. For only an instant moment more, the voltage on the slow line at the inner diameter will still be at the original charge level and polarity. As such, after the wave 25 arrives but before the wave 24 arrives at the inner diameter, the field voltages on the inner ends of both lines are oriented in the same direction and add to one another, as shown in FIG. 5B. Such adding of fields produces an impulse field that can be used to accelerate a beam. Such an impulse field is neutralized, however, when the slow wave 24 eventually arrives at the inner diameter, and is reflected. This reflection of the slow wave 24 reverses the polarity of the slow line, as is illustrated in FIG. 5C. The time that the impulse field exists can be extended by increasing the distance that the voltage waves 24 and 25 must traverse. One way is to simply increase the outside diameter of the single accelerator cell. Another, more compact way is to replace the solid discs of the conductive plates 14, 16 and 18 with one or more spiral conductors that are connected between conductor rings at the inner and/or outer diameters.

By arranging multiple Blumleins unit cells 10 over a continuous dielectric wall, the charged particle beam can be accelerated through the central axis of the multi-stage DWA by sequentially generating the appropriate voltage pulse for each section of the multi-stage DWA. As such, by timing the closing of the switches (as illustrated in FIGS. 5A to 5C), the generated electric field on the dielectric wall can be made to move at any desired speed. In particular, such a movement of the electric field can be made synchronous with the proton beam pulse that is input to the DWA, thereby accelerating the proton beam in a controlled fashion that resembles a "traveling wave" that is propagating down the DWA axis. It is advantageous to make the duration of these pulses as short as possible since the DWA can withstand larger fields for pulses with narrow durations.

Figure 6A:
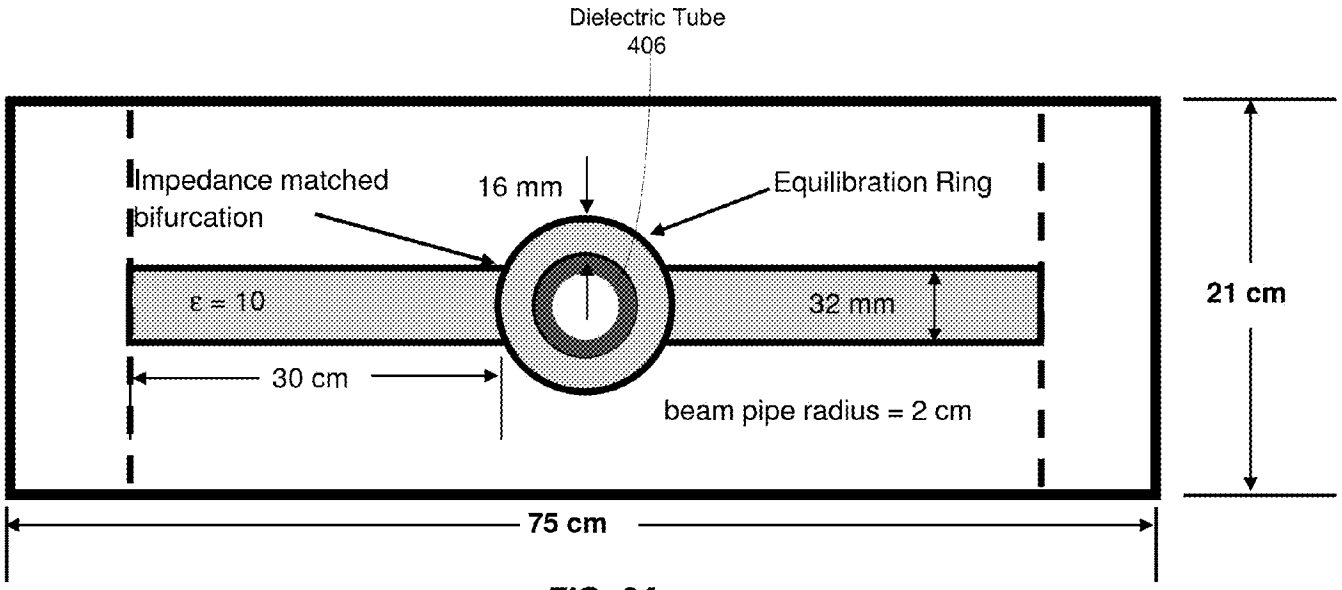
FIGS. 6A and 6B illustrate additional details of the DWA system in FIG. 4.
Figure 6B:
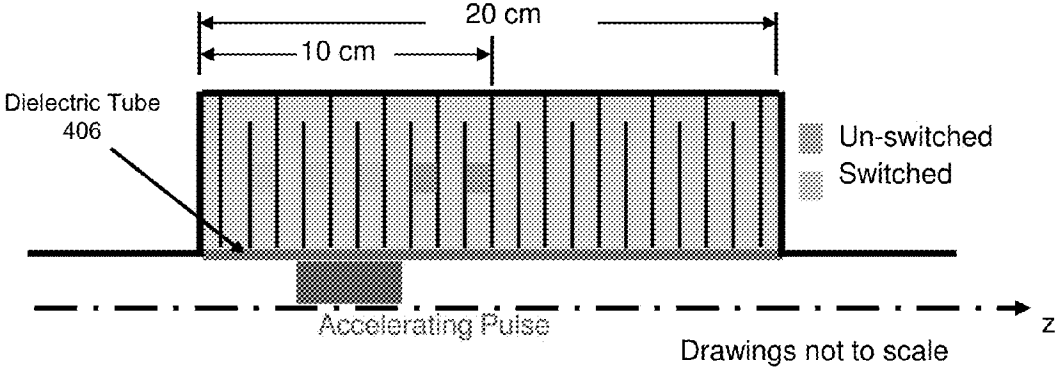

FIGS. 6A and 6B illustrate additional details of the DWA system in FIG. 4. FIG. 6A shows a conductor ring is formed outside and surrounds the dielectric tube and is electrically coupled to the conductors a respective Blumleins unit cell 408. This conductor ring is an equilibration ring because it allows the voltage from the Blumleins unit cell 408 to be distributed azimuthally and uniformly distributed on the dielectric tube section. FIG. 6B further shows a pulse or packet of charged particles being accelerated along the dielectric tube.

In operation, one or two adjacent Blumleins unit cells 408 are turned on at a time at the location where the pulse or packet of charged particles are traveling to produce the tube lengthwise accelerating electric field inside the DWA tube 406. After the pulse or packet of charged particles pass through the location, the one or two adjacent Blumleins unit cells 408 are tuned off and the downstream one or two adjacent Blumleins unit cells 408 are turned on to further accelerate the charged particles. This process repeats until the pulse or packet of charged particles exit the DWA tube 406.

As described with respect to FIGS. 5A-5C, when a Blumleins unit cell 408 is turned on, there is a time-varying voltage pulse or current in the conductor lines to produce a transient magnetic field around the Blumleins unit cell 408 and the adjacent Blumleins unit cells 408 (which may be turned off) are exposed to this transient magnetic field and thus an eddy current can be induced in the adjacent Blumleins unit cells 408.

Figure 7B:
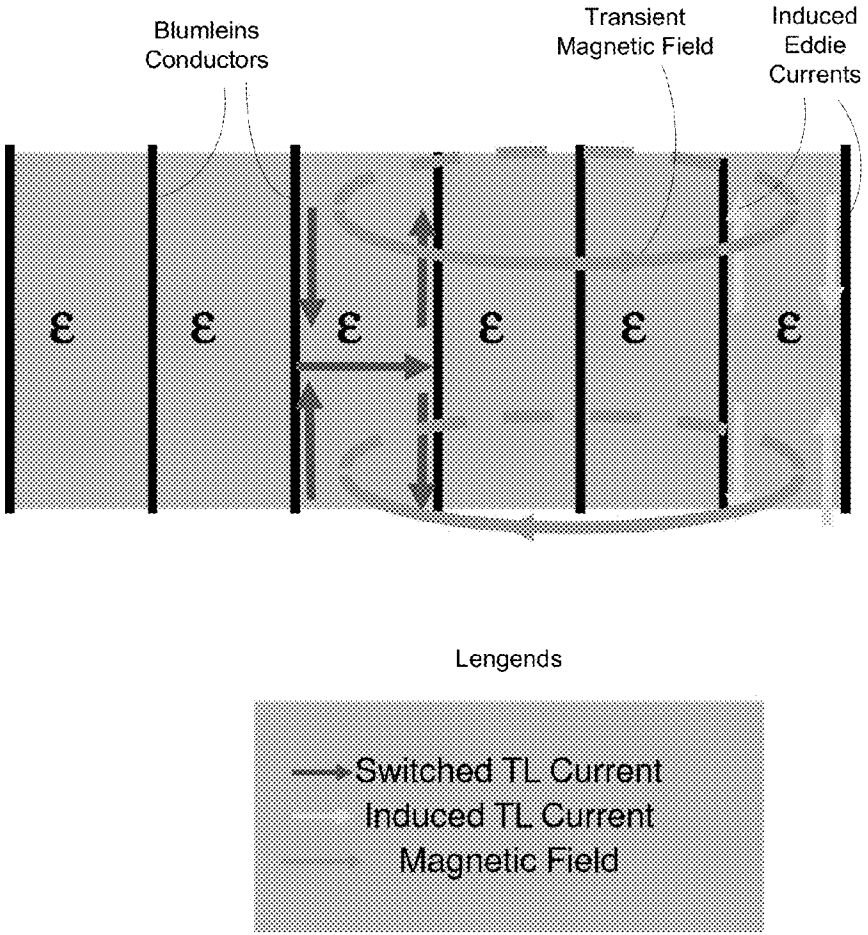
FIGS. 7A and 7B illustrate the magnetic induction in Blumleins device conductors.
Figure 7A:
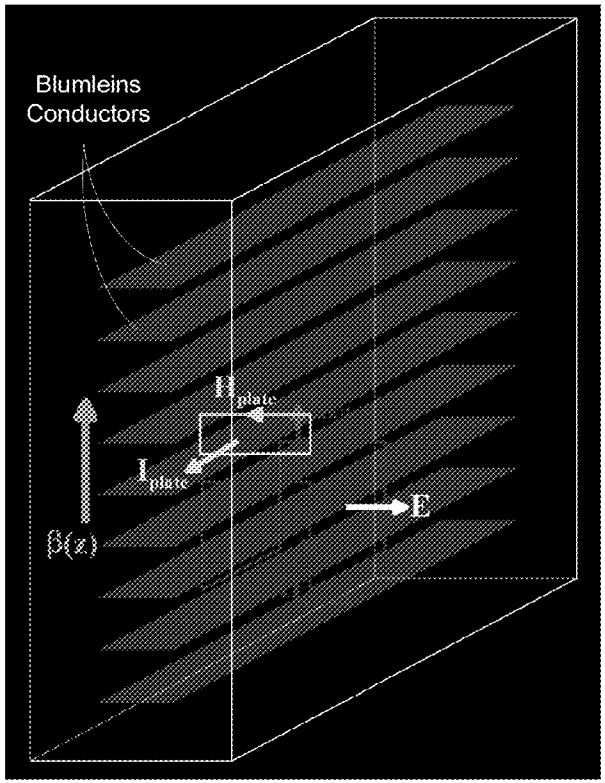

FIGS. 7A and 7B illustrate the above situation. FIG. 7A illustrates parallel Blumleins conductors outside the DWA tube and different currents and their magnetic fields. FIG. 7B shows the induced eddy currents as the induced transmission line (TL) currents in adjacent Blumleins unit cells.

Therefore, in absence of any preventive mechanisms such as diamagnetic composite material structure disclosed here, the electromagnetic induction caused by the transient magnetic field leads to non-local magnetic coupling to adjacent Blumleins unit cells and thus loss of electric energy in the Blumleins unit cell that is currently turned on since the signal energy is lost to the induced eddy currents in adjacent Blumleins unit cells. This loss reduces the amplitude or strength of the tube lengthwise accelerating electric field inside the DWA tube and thus the overall acceleration of the entire DWA tube. In addition, the induced eddy currents in adjacent Blumleins unit cells can also cause pulse shape distortion in the pulse or packet of charged particles under acceleration.

Such undesired effects due to the non-local magnetic coupling can be reduced by implementing the disclosed diamagnetic composite material structure of diamagnetic composite sheets outside the Blumleins unit cells to surround the dielectric tube and the unit cells. Each diamagnetic composite sheet has a full metal coverage on both sides and thus blocks field lines of the transient magnetic fields. In addition, each diamagnetic composite sheet connected to at least one conductor line in a respective unit cell as a high impedance structure to reduce a magnetic field induced current in a conductor within a Blumleins unit cell. Referring back to FIG. 3, the conductors No. 1 and No. 2 can be the conductors of Blumleins unit cells and the diamagnetic composite sheets No. 1 and No. 2 constitute part of the diamagnetic composite material structure in the DWA system.

Figures 8A, 8B:
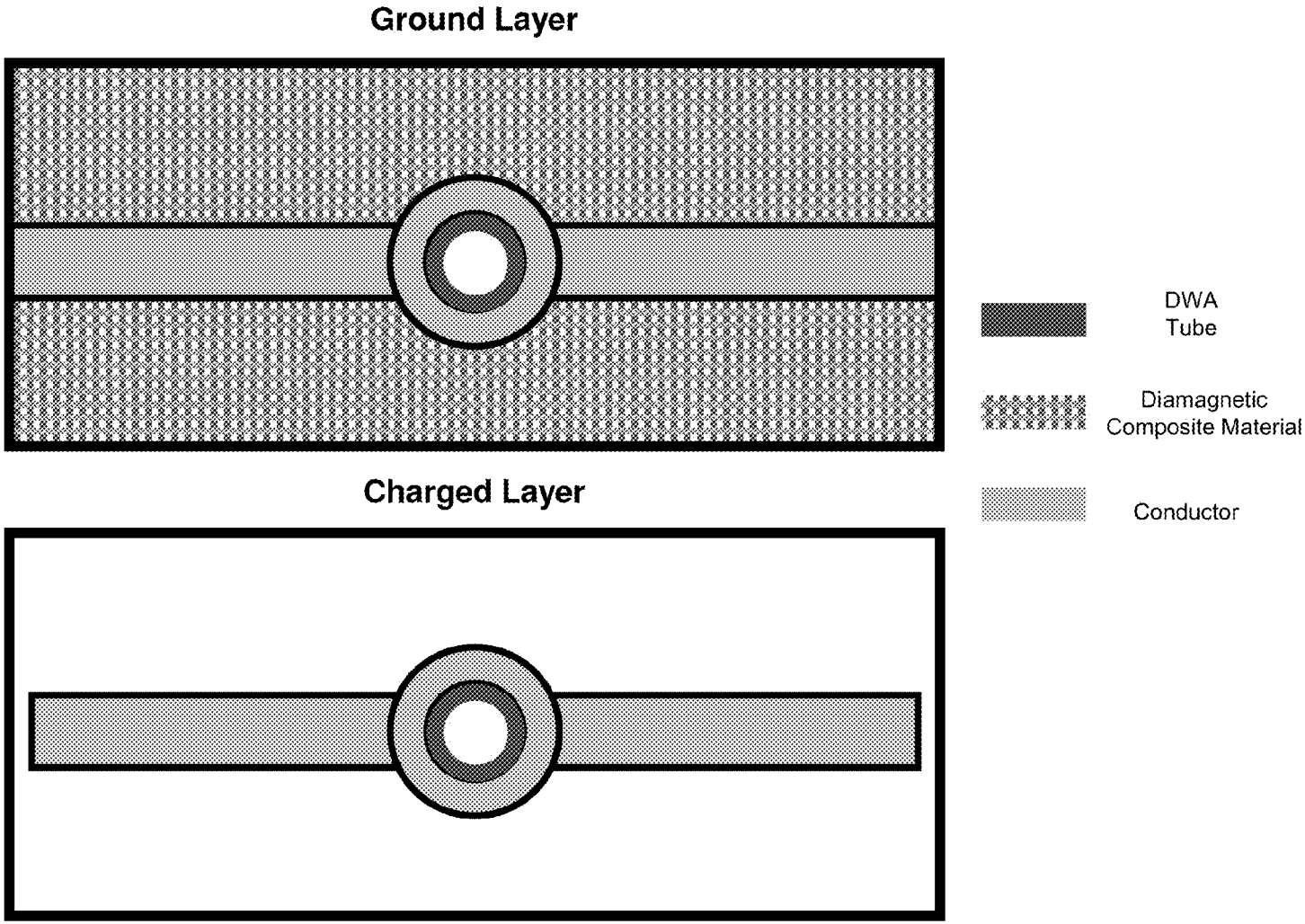
FIGS. 8A, 8B, 9A and 9B show examples of a diamagnetic composite material structure coupled to Blumleins device conductors in a DWA system.

FIGS. 8A and 8B show an example of the above diamagnetic composite material structure in the DWA system in a cross section perpendicular to the tube lengthwise direction of the DWA tube. FIG. 8A shows a ground conductor layer where the diamagnetic composite material outside the Blumleins unit cells is shown. FIG. 8B shows the charged conductor layer which is not connected to a diamagnetic composite sheet.

Figure 9B:
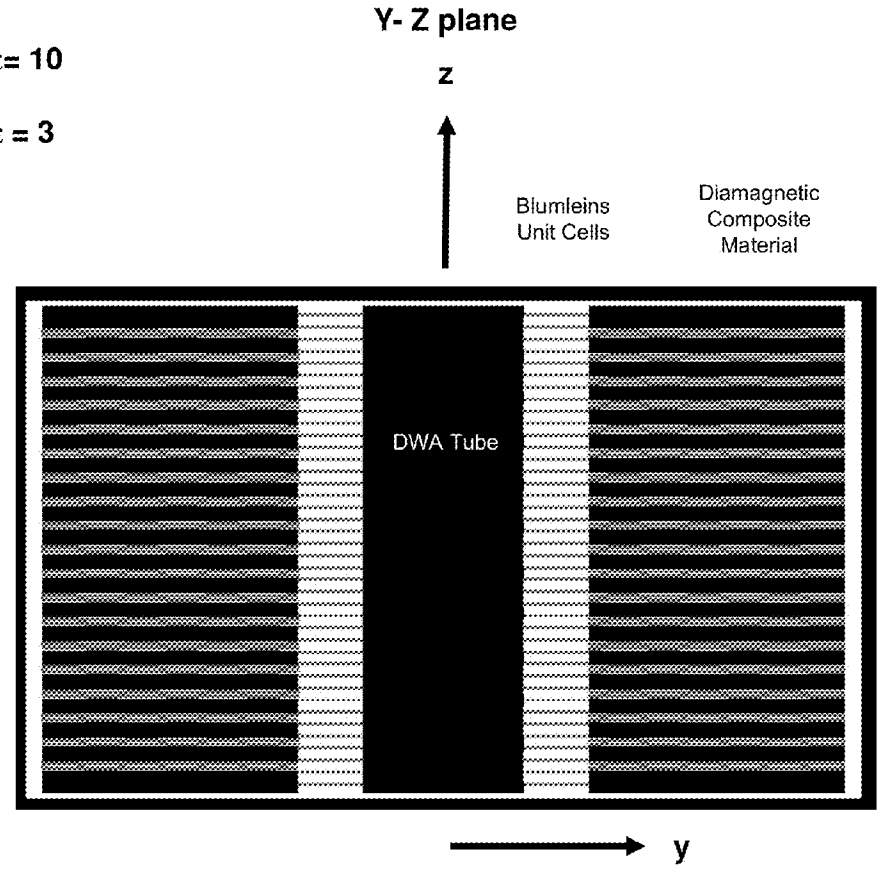
Figure 9A:
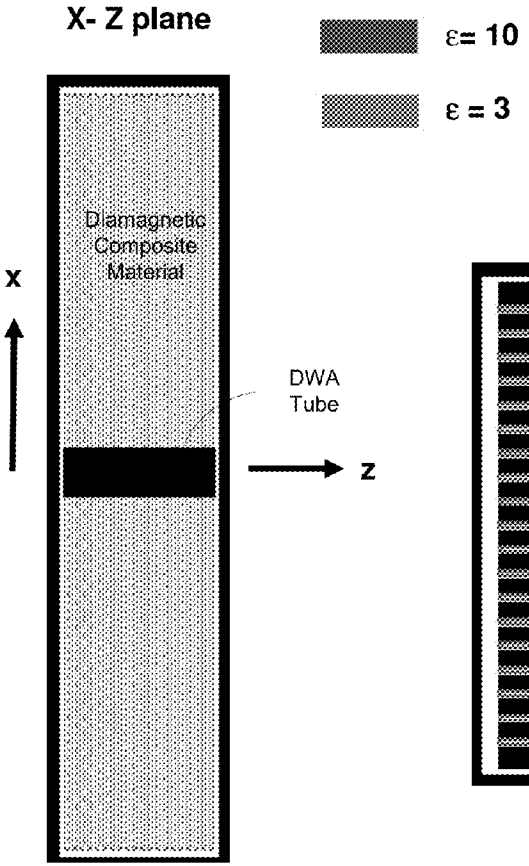

FIGS. 9A and 9B show two other views of the above diamagnetic composite material structure in the DWA system. FIG. 9A shows that the diamagnetic composite material structure is outside the DWA tube. FIG. 9B shows a cross section view to showing the Blumleins unit cells and the diamagnetic composite material structure surrounding the Blumleins unit cells.

Figure 10B:
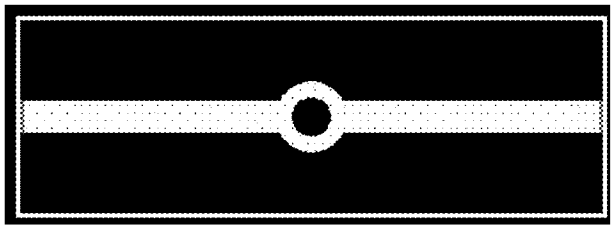
FIGS. 10A and 10B further show a 3-layer diamagnetic composite material structure.
Figure 10A:
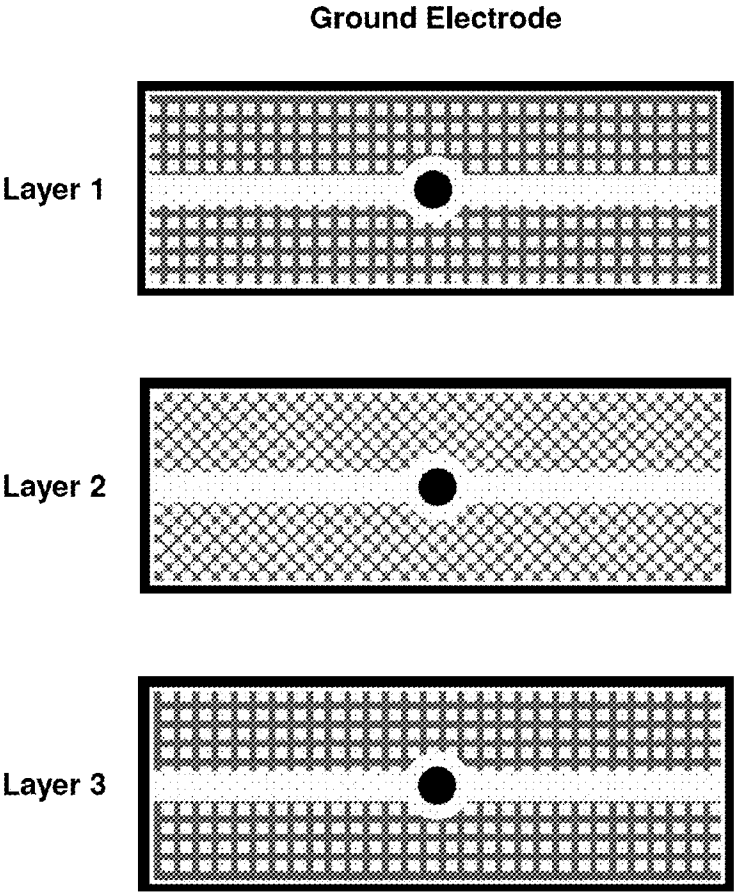

FIGS. 10A and 10B further show a 3-layer diamagnetic composite material structure.

Figure 11A:
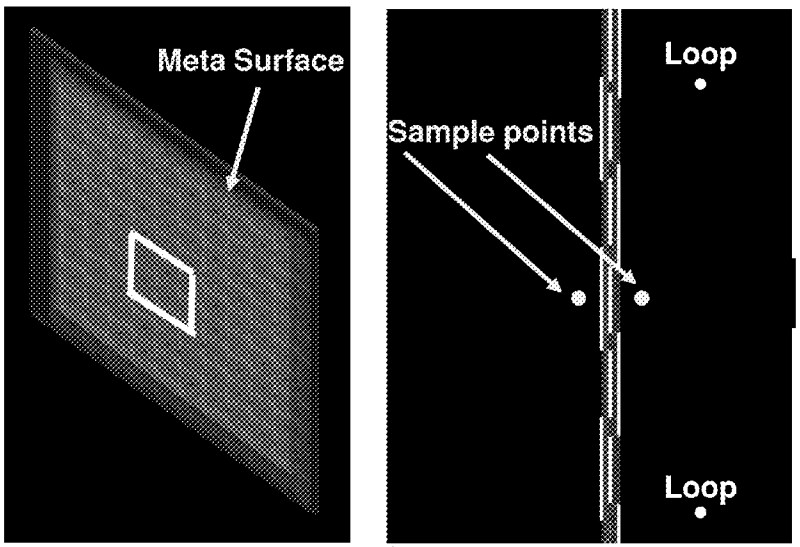
FIGS. 11A, 11B, 11C and 11D show the effect of blocking the magnetic field by a diamagnetic composite sheet.
Figure 11B:
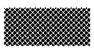
Figure 11C:
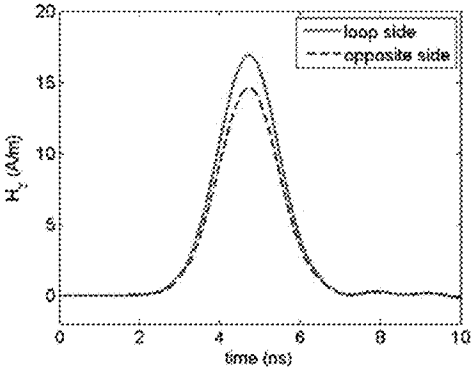
Figure 11D:
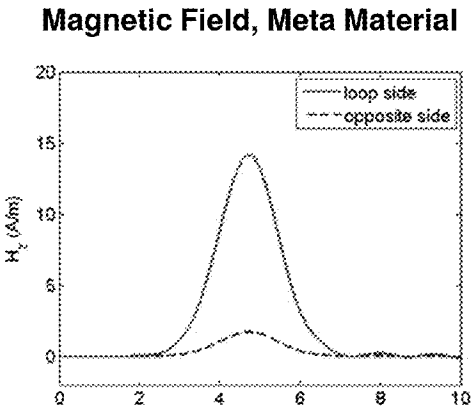

FIGS. 11A, 11B, 11C and 11D show the effect of blocking the magnetic field by a diamagnetic composite sheet. As shown in FIGS. 11A and 11B, a simple square conductor loop is used to receive an electric current and is placed on one side of the diamagnetic composite sheet. The magnetic field produced by the current in the square conductor loop is measured on the loop side of the diamagnetic composite sheet where the magnetic field is not blocked and on the opposite side of the diamagnetic composite sheet where the magnetic field is blocked by the diamagnetic composite sheet. FIG. 11D shows the field blocking effect by the diamagnetic composite sheet. In comparison, FIG. 11C shows the field blocking effect by a dielectric sheet where the blocking is significantly less than the diamagnetic composite sheet. Due to this blocking effect, such a composite sheet is diamagnetic in this context.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. A dielectric wall accelerator for accelerating charged particles, comprising:

a dielectric tube to receive a pulse of charged particles propagating along a tube lengthwise direction of the dielectric tube;

a series of unit cells located outside, and engaged to, different tube sections of the dielectric tube, the unit cells each including parallel electrical conductor lines transversely connected to the different tube sections, respectively, and spaced apart along the tube lengthwise direction to apply electrical signals to effectuate acceleration electrical fields at the different tube sections along the tube lengthwise direction inside the dielectric tube;

a control device coupled to the unit cells to supply electrical power to the parallel electrical conductor lines within the unit cells and to control the unit cells to turn on and off the applied electrical signals in the unit cells, respectively, one unit cell at a time sequentially along the tube lengthwise direction to synchronize the acceleration electrical field at the different tube sections with propagation of the pulse of charged particles to accelerate the charged particles; and a diamagnetic composite material structure outside the unit cells to surround the dielectric tube and the unit cells and including diamagnetic composite sheets that are separated from one another to provide a high impedance composite material structure, wherein each diamagnetic composite sheet includes patterned conductor layers that are separated by a dielectric material and each include voids and conductor areas, wherein voids in the patterned conductor layers of each diamagnetic composite sheet are arranged to be displaced in position from one patterned conductor layer to an adjacent patterned conductor layer while conductor areas of the patterned conductor layers collectively form a contiguous conductor structure in each diamagnetic composite sheet to prevent penetration by a magnetic field, and wherein each diamagnetic composite sheet is connected to at least one conductor line in a respective unit cell to reduce a magnetic field induced current.

2. The dielectric wall accelerator as in claim 1, wherein:

each diamagnetic composite sheet includes three patterned conductor layers.

3. The dielectric wall accelerator as in claim 1, wherein:

one of the patterned conductor layers in each diamagnetic composite sheet is connected to a conductor line in a respective unit cell.

4. The dielectric wall accelerator as in claim 1, wherein:

a patterned conductor layer of a diamagnetic composite sheet is a conductor sheet in which the conductor areas are connected to define holes as the voids.

5. The dielectric wall accelerator as in claim 1, wherein:

a patterned conductor layer of a diamagnetic composite sheet includes conductor areas that are separated from one another by the voids.

6. The dielectric wall accelerator as in claim 1, wherein:

a patterned conductor layer of a diamagnetic composite sheet includes separated conductor areas that are closed conductor loops.

7. The dielectric wall accelerator as in claim 1, wherein:

a patterned conductor layer of a diamagnetic composite sheet includes separated conductor areas that are contiguous conductor patches.

8. The dielectric wall accelerator as in claim 1, comprising:

conductor rings formed outside of and enclosing the dielectric tube, the conductor rings being isolated from one another and arranged at different unit cell locations along the tube lengthwise direction, each conductor ring being connected to the conductor lines of a corresponding unit cell to effectuate a respective acceleration electrical field along the tube lengthwise direction inside the dielectric tube.

9. The dielectric wall accelerator as in claim 1, wherein:

the dielectric tube includes high gradient insulator that includes alternating dielectric and conductor materials.

10. The dielectric wall accelerator as in claim 1, wherein:

the control device includes photoconductive switches coupled to the unit cells, respectively, each photoconductive switch operable to be activated by light to switch on and off a respective electrical signal applied to the parallel electrical conductor lines within each unit cell.

11. A method for reducing electromagnetic interference in a dielectric wall accelerator for accelerating charged particles that includes a dielectric tube, a stack of Blumlein unit cells located outside, and engaged to, different tube sections of the dielectric tube to apply electrical signals to effectuate acceleration electrical fields at the different tube sections along a tube lengthwise direction inside the dielectric tube, comprising:

providing a diamagnetic composite material structure outside the Blumlein unit cells to surround the dielectric tube and the Blumlein unit cells to reduce magnetic interference caused by one Blumlein unit cell to other Blumlein unit cells, wherein the diamagnetic composite material structure include diamagnetic composite sheets that are separated from one another and each diamagnetic composite sheet includes patterned conductor layers that are separated by a dielectric material and each include voids and conductor areas, and wherein voids in the patterned conductor layers of each diamagnetic composite sheet are arranged to be displaced in position from one patterned conductor layer to an adjacent patterned conductor layer while conductor areas of the patterned conductor layers collectively form a contiguous conductor structure in each diamagnetic composite sheet to prevent penetration by a magnetic field; and connecting each diamagnetic composite sheet to one or more conductors in a respective Blumlein unit cell to reduce a magnetic field induced current.

12. The method as in claim 11, wherein:

each diamagnetic composite sheet includes three patterned conductor layers.

13. The method as in claim 11, wherein:

one of the patterned conductor layers in each diamagnetic composite sheet is connected to a conductor line in a respective unit cell.

14. The method as in claim 11, wherein:

a patterned conductor layer of a diamagnetic composite sheet is a conductor sheet in which the conductor areas are connected to define holes as the voids.

15. The method as in claim 11, wherein:

a patterned conductor layer of a diamagnetic composite sheet includes conductor areas that are separated from one another by the voids.

16. The method as in claim 11, wherein:

a patterned conductor layer of a diamagnetic composite sheet includes separated conductor areas that are closed conductor loops.

17. The method as in claim 11, wherein:

a patterned conductor layer of a diamagnetic composite sheet includes separated conductor areas that are contiguous conductor patches.

18. A device having a reduced electromagnetic interference, comprising:

a series of circuits located adjacent to one another, each circuit including electrical conductors to carrying one or more time-varying electric currents which induce one or more time-varying magnetic fields that extend to one or more adjacent circuits and thus induce magnetic field induced eddy currents in electrical conductors of the one or more adjacent circuits; and a diamagnetic composite material structure coupled to the circuits to surround the circuits and including diamagnetic composite sheets that are separated from one another to provide a high impedance composite material structure, wherein each diamagnetic composite sheet includes patterned conductor layers that are separated by a dielectric material and each include voids and conductor areas, wherein voids in the patterned conductor layers of each diamagnetic composite sheet are arranged to be displaced in position from one patterned conductor layer to an adjacent patterned conductor layer while conductor areas of the patterned conductor layers collectively form a contiguous conductor structure in each diamagnetic composite sheet to prevent penetration by a magnetic field, and wherein the diamagnetic composite sheets are electrically coupled to the circuits, respectively, to reduce a magnetic field induced eddy current in one circuit that is caused by another circuit, the patterned conductor layers in each diamagnetic composite sheet being electrically coupled to electrical conductors of a respective circuit.

19. The device as in claim 18, wherein:

one of the patterned conductor layers in each diamagnetic composite sheet is connected to a conductor line in a respective unit cell.

20. The device as in claim 18, wherein:

a patterned conductor layer of a diamagnetic composite sheet is a conductor sheet in which the conductor areas are connected to define holes as the voids.

21. The device as in claim 18, wherein:

a patterned conductor layer of a diamagnetic composite sheet includes conductor areas that are separated from one another by the voids.

22. The device as in claim 18, wherein:

a patterned conductor layer of a diamagnetic composite sheet includes separated conductor areas that are closed conductor loops.

23. The device as in claim 18, wherein:

a patterned conductor layer of a diamagnetic composite sheet includes separated conductor areas that are contiguous conductor patches.

* * * * *